United States Patent [19]

Gauger

[11] 4,158,980

[45] Jun. 26, 1979

[54] MOUNTING BRACKET FOR DRUMS

[76] Inventor: Gary L. Gauger, 15108 Highland La., Minnetonka, Minn. 55343

[21] Appl. No.: 869,915

[22] Filed: Jan. 16, 1978

[51] Int. Cl.[2] ..... G10G 5/00; G10D 13/02

[52] U.S. Cl. ..... 84/421

[58] Field of Search ..... 84/411 R, 419, 421, 84/453

[56] References Cited

U.S. PATENT DOCUMENTS

| | | | |
|---|---|---|---|
| 2,990,745 | 7/1961 | Casavant | 84/421 |
| 3,106,123 | 10/1963 | Johannsen | 84/421 |
| 3,191,484 | 6/1965 | Walling | 84/421 |
| 3,608,418 | 9/1971 | Chaffee et al. | 84/419 |

*Primary Examiner*—Lawrence R. Franklin

*Attorney, Agent, or Firm*—Williamson, Bains, Moore & Hansen

[57] ABSTRACT

A bracket for mounting drums of the tom-tom type consists of an arcuate member having inwardly directed flanges which have apertures to mount to the pre-existing lugs of the drum. Vibration absorbing grommets are provided in the flanges in order to provide both a resilient support as well as to cut down vibration transfer into the drum stand to which the bracket is mounted. The bracket is essentially semi-circular and provides its main support at diametrically opposed points of the drum and utilizes additional fastening points for balancing.

10 Claims, 4 Drawing Figures

MOUNTING BRACKET FOR DRUMS

BRIEF SUMMARY OF THE INVENTION

In the past, so-called tom-tom drums have generally been mounted for playing by the drummer by one of two methods. First, a bracket is affixed to the bass drum and the other end of the bracket is mounted usually by screws to the middle of the shell of the tom-tom. This method of mounting produces the undesirable result that vibration of the middle region of the shell of the drum is severely dampened due to the engagement of the relatively fixed support bearing the weight of the drum. Such dampening results in decreased loudness, tonal quality, and length of resonance. The second method of mounting the tom-toms amounts to setting each drum on a separate stand similar to a snare drum stand and having three arms with upturned tips that cradle the drum. While this type of stand results in a desirable tonal quality, it has the disadvantage that the drums generally must be placed further from the drummer and that the use of a larger number of drums as is popular today results in an unwieldy arsenal of stands which additionally cannot, in general, be positioned completely to the drummer's liking.

Previous alternative attempts for mounting drums are shown in U.S. Pat. Nos. 2,433,594, 2,588,830 and 3,780,613. In U.S. Pat. Nos. 2,433,594 and 2,588,830, brackets are mounted to the drum lugs. There is, however, no provision for dampening vibration to be passed through those lugs nor is the novel method of balance and support disclosed by the instant invention taught in these two references. Further, neither shows the novel arcuate mounting bracket which provides all the advantages of the instant invention in conjunction with a compact size and shape.

It is therefore an object of this invention to provide a device which may be inexpensively and expeditiously manufactured. It is a further object of this device to mount a drum in such a fashion that the drum and especially the shell are allowed to sound in a natural, unrestrained fashion. It is yet another object of this invention to provide a mounting bracket which may be utilized with pre-existing hardware so as to be adaptable to pre-existing drum sets and hardware.

These advantages are provided in the instant invention by the provision of a generally semi-circular arcuate member which has a plurality of flanges depending radially inwardly therefrom. The flanges have apertures located therein and the arcuate member and flanges are sized so as to mount the flanges to a drum with the lugs of the drum passing through the apertures. In such an arrangement the two end apertures generally serve to support and balance the drum about approximately at center line and the intermediate apertures serve to steady and balance the drum with very little of the supporting load being taken up at those apertures. Rubber grommets are provided in the apertures so as to serve to dampen and absorb what little vibration does exist at the lugs of the drums thereby preventing such vibration from being transferred to the stand to which the drum is mounted.

These and other objects and advantages of my invention will become readily apparent as the following description is read in conjunction with the accompanying drawings wherein like reference numerals refer to the same or similar parts throughout the several views.

DESCRIPTION OF THE DRAWING FIGURES

DETAILED DESCRIPTION OF THE INVENTION

Figure 1:
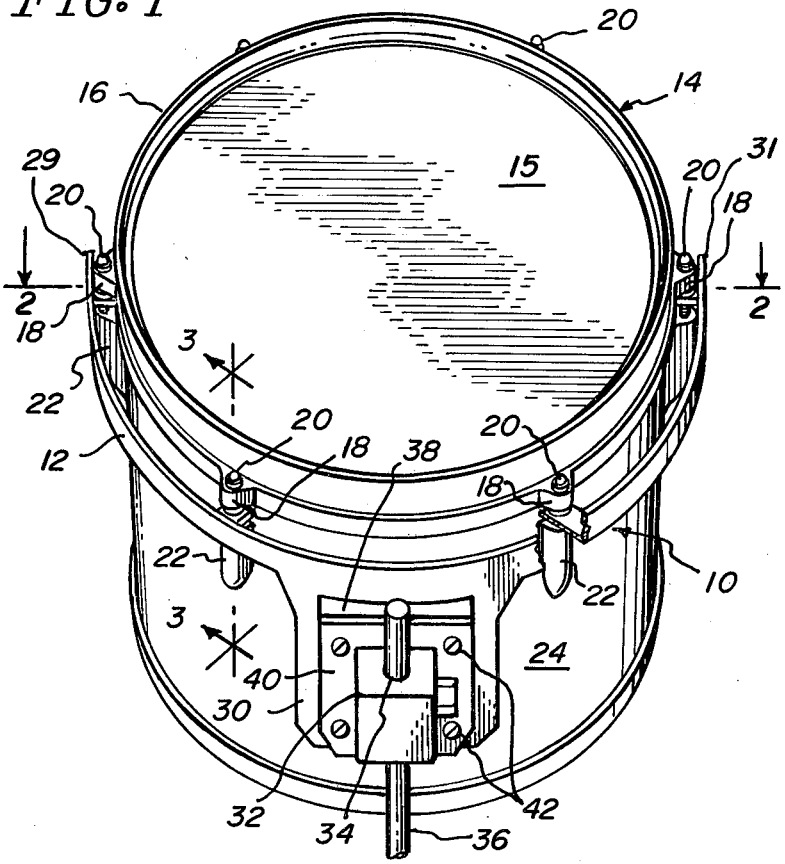
FIG. 1 is a perspective view showing the mounting bracket in place on a drum.
Figure 3:
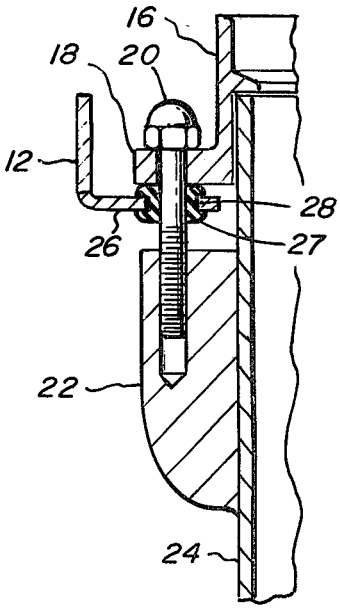
FIG. 3 is a sectional view taken along lines 3—3 of FIG. 1.

A drum, generally 14, of the tom-tom type is generally provided with a cylindrical shell 24 having located at one or both ends thereof a plurality of castings 22. The drum head 15 is held in place by rim 16 which has a plurality of outwardly extending earlike protrusions 18 having apertures located therein. Lugs 20 are generally bolt-like members which pass through protrusion 18 and thread into casting 22. (See FIG. 3) Lugs 20 may be tightened in order to tune the drum. The drum head is mounted conventionally between the rim and shell (not shown) and such mounting does not form part of this invention.

A conventional drum, when sounded, will vibrate mainly at the head and, if unrestrained, at the shell. Shell vibration being at a maximum at the mid-point. The term "substantially nonvibrating portions" refers to those portions of the drum where vibration is relatively minimal such as the rim, lugs, and castings.

Figure 2:
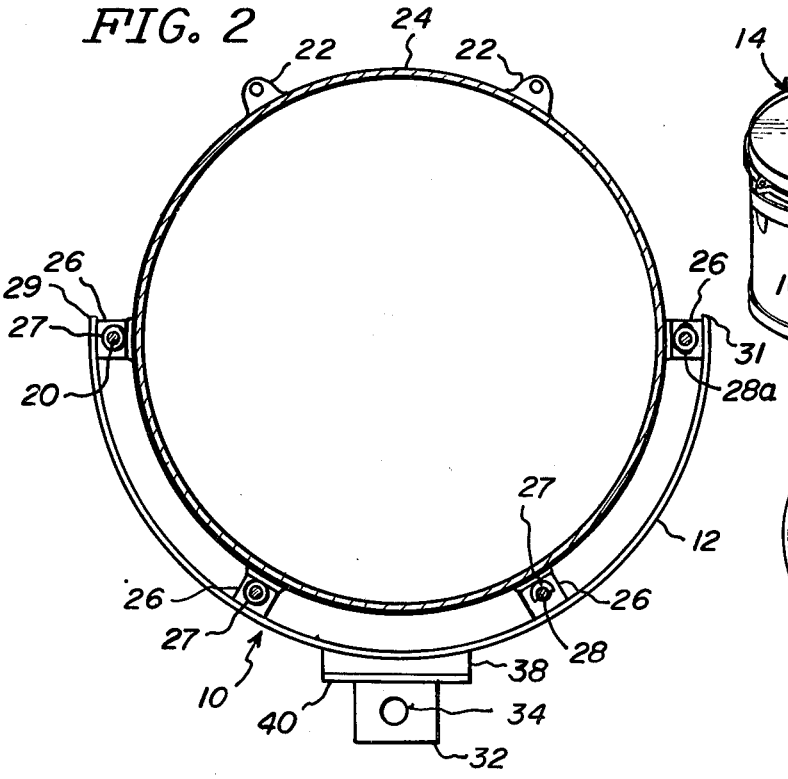
FIG. 2 is a vertical sectional view of the mounting bracket taken along lines 2—2 of FIG. 1.
Figure 4:
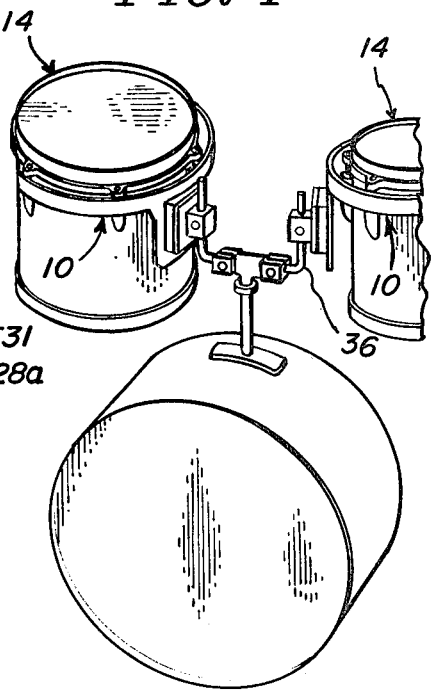
FIG. 4 is a perspective view of the device as used in a typical drum set.

The drum mounting bracket of the instant invention is generally designated 10 and comprises a laterally extending arcuate strip 12 which may be formed of steel, aluminum or similar strong yet resilient materials. A plurality of flanges 26 depend radially inwardly from arcuate strip 12 at spaced locations. (FIG. 2) Each of said flanges 26 have located therein an aperture 28. Each such aperture 28 contains a conventional rubber grommet 27. Arcuate strip 12 is provided with two ends 29 and 31. The flanges 26 adjacent one or both of these ends have an aperture **28*a*** elongated in the form of a slot in the circumferential direction. This elongation serves to make up for minor variations in size and dimension between drums and thus makes the mounting bracket of the instant invention more universally adaptable to any drum of the particular size. If desired any number of the flanges may be slotted in this manner.

In order to mount the bracket 10 arcuate member 12 is placed parallel to and adjacent to drum rim 16 such that radially inwardly extending flanges 26 are interposed between ear-like protrusions 18 of the drum rim and castings 22. The standard drum lug 20 is then passed successively through earlike protrusion 18, flange 26, grommet 27, and into casting 22 wherein it is threadingly engaged.

Arcuate member 12 has attached or formed integrally therewith a plate 30. Plate 30 extends downwardly and parallel to the shell 24 of the drum. Attached to plate 30 is connector member 32. Member 32 serves to connect plate 30 to support piece 36. Member 32 may be a conventional piece which is normally secured to the shell 24 of the drum but instead may be secured to plate 30 so as to attach the drum assembly to support stand 36. A rubber insulator 38 is interposed between connector member 32 and plate 30. In order to spread the load over a larger area, an extra piece 40 may be inserted between insulator 38 and connector member 32. Screws 42 may be used for securement.

The novel method of support is provided in that the flanges 26 nearest ends 29 and 31 of arcuate member 12 act to support the drum by providing a plane of support which substantially intersects the center of gravity of the drum. The remaining flanges 26 then act mainly to balance the drum on the stand and take up little of the load. Were one to attempt to support the drum by only two adjacent flanges a fairly high bending moment would be exerted on the lugs 20 and flanges 26, possibly breaking or bending one or the other. By providing the main support at intervals spaced as close to 180 degrees as possible from each other no significant bending moments are imparted from the mounting and the aforementioned problems are minimized. While the figures shown illustrate the use of the device with a six-lug drum which is by far the most common arrangement, the device of the instant invention may also be used with drums having five lugs or any other number so that the drum is suspended from approximately opposite sides and intermediate supporting positions are used mainly to balance the drum on the bracket and stand. The lugs on tom-toms are generally evenly spaced. Since it is desired to support the drum from approximately diametrically opposite sides as well as at intermediate positions, a six lug drum exhibits the most desirable spacing, that being a span of about 180 degrees in the process of engaging four lugs. On a five lug drum, since no two lugs are diametrically opposed, it is desired to engage four of the lugs thus requiring a span of about 216 degrees. Since the lug number or spacing may vary, it is seen that a range of spans from 150 to 230 degrees should handle most drums.

The arcuate member 12 may be supplied with a radius of curvature slightly greater than that of the drum such that when, in an unmounted position, the apertures and flanges 26 at ends 29 and 31 are slightly farther apart than the corresponding lugs 20 to which they will be mounted. When it is desired to mount the drum, ends 29 and 31 are forced slightly inwardly against the resiliency of member 12 and the lugs inserted. This will provide a slight outward tension at those points which will thus serve to assure that flanges 26 do not contact shell 24 of the drum. Alternatively, the radius may be slightly less so that ends 29 and 31 must be forced outwardly for mounting thereby providing an inward tension.

It is to be noted that while in the drawings flanges 26 are shown as depending integrally inwardly from one edge of arcuate member 12 several variations of this device would fall within the inventive spirit disclosed here. Such variations could include either integral formation of flanges 26 with arcuate member 12, attachment of flanges by welding or other conventional means to the member 12, or for instance the provision of one long flange having several apertures located therein to take the place of the several flanges here disclosed. In such an arrangement arcuate member 12 would actually have an L-shaped cross section with grommets 28 being located in the leg of the L that is faced radially inwardly. Similarly flanges 26 could depend inwardly from any point intermediate the two edges. Accordingly, any number of variations of the instant invention may be made to assure a compact arrangement of the arcuate member relative to the drum so that the device may be placed into pre-existing drum cases. Care must also be taken that the arcuate member 12 and associated flanges 26 do not touch the shell of the drum so as to undesirably restrain vibration of shell 24.

It is contemplated that various changes and modifications may be made to my drum mounting bracket without departing from the spirit and scope of my invention as defined by the following claims.

What is claimed is:

1. A mounting bracket for drums of the type having a cylindrical shell and a plurality of lugs, said bracket comprising:

an arcuate member having two ends and having a diameter slightly larger than the drum to be mounted thereto, said arcuate member further comprises means for engaging substantially diametrically opposed lugs of a drum and at least one lug intermediate said opposed lugs;

means for attaching said arcuate member to a conventional fixed support; and said bracket being free of contact with said shell.

2. The device of claim 1 wherein said engaging means comprises a plurality of flanges attached to and extending radially inwardly from said member, each of said flanges having an aperture therein to engagement with one of said lugs.

3. The device of claim 2 further comprising a vibration-absorbing means associated with each of said flanges.

4. The device of claim 3 wherein said vibration-absorbing means comprises a plurality of grommets and each of said grommets is located in a corresponding said aperture.

5. The device of claim 2 wherein said apertures comprise circumferentially elongated slots.

6. The device of claim 2 wherein the extent of the arc of said arcuate member is about 150 to 230 degrees.

7. The device of claim 6 wherein the extent of the arc of said arcuate member is about 216 degrees.

8. The device of claim 6 wherein the extent of the arc of said arcuate member between the two flanges nearest each of said two ends is about 180 degrees.

9. The device of claim 2 wherein the aperture nearest each of said two ends are located at a radius of the arcuate member which is slightly greater than the radius of the lugs to which it is to be attached, and said member is made of a resilient material such that when said member is mounted to a drum said member must flex radially inwardly at said two ends for attachment to said lugs;

whereby said two ends exert a radially outward tension at the said two end apertures.

10. In combination with a drum of the type having a rim, a plurality of castings, and cylindrical shell and a plurality of lugs circumferentially spaced at one end of said shell, a mounting bracket comprising:

an arcuate member having two ends and being of a diameter slightly larger than said drum and extending for an arc of about 150 to 230 degrees;

said bracket having at least three flanges extending radially inwardly from said arcuate member, one of said flanges being located adjacent each of said ends and at least one of said flanges located intermediate said end flanges; said bracket being free of contact with said shell.

* * * * *